US010096192B1

(12) United States Patent
Krenn

(10) Patent No.: US 10,096,192 B1
(45) Date of Patent: Oct. 9, 2018

(54) CHIP SORTING DEVICES AND RELATED ASSEMBLIES AND METHODS

(71) Applicant: Shuffle Master GmbH & Co KG, Vienna (AT)

(72) Inventor: Peter Krenn, Neufeld (AT)

(73) Assignee: Shuffle Master GmbH & Co KG, Vienna (AT)

( * ) Notice: Subject to any disclaimer, the term of this patent is extended or adjusted under 35 U.S.C. 154(b) by 0 days.

(21) Appl. No.: 15/690,533

(22) Filed: Aug. 30, 2017

(51) Int. Cl.

| | |
|---|---|
| ***G07D 9/06*** | (2006.01) |
| ***G07D 3/02*** | (2006.01) |
| ***G07D 9/00*** | (2006.01) |
| *G07D 11/00* | (2006.01) |

(52) U.S. Cl.
CPC ..... *G07D 3/02* (2013.01); *G07D 9/002* (2013.01); *G07D 11/0003* (2013.01)

(58) Field of Classification Search
CPC ..... G07D 1/00; G07D 9/002; G07D 9/06; G07D 11/0003
See application file for complete search history.

(56) References Cited

U.S. PATENT DOCUMENTS

| | | | | |
|---|---|---|---|---|
| 1,200,843 | A | 10/1916 | Baur | |
| 1,241,632 | A | 10/1917 | Johnson | |
| 1,813,296 | A * | 7/1931 | Kidwell | G07D 3/06 453/12 |
| 1,947,456 | A | 2/1934 | Bock | |
| 2,020,293 | A | 11/1935 | Adelstein | |
| 2,073,789 | A | 3/1937 | Gee | |
| 2,163,351 | A | 6/1939 | Paul | |
| 2,231,093 | A | 2/1941 | Seemel | |
| 2,904,151 | A | 9/1959 | Johnson | |
| 3,143,118 | A | 8/1964 | Haines | |
| 3,371,761 | A | 3/1968 | Rya | |
| 3,387,616 | A | 6/1968 | Bortz et al. | |
| 3,435,833 | A | 4/1969 | Tanaka | |
| 3,463,171 | A | 8/1969 | Dolman | |
| 3,497,047 | A | 2/1970 | Mobley | |
| 3,583,410 | A | 6/1971 | Bayha et al. | |
| 3,625,230 | A | 12/1971 | Zschaeck et al. | |
| 3,680,566 | A | 8/1972 | Tanaka et al. | |
| 3,766,452 | A | 10/1973 | Burpee et al. | |
| 3,771,538 | A | 11/1973 | Reis | |
| 3,827,582 | A | 8/1974 | Lederer | |
| 3,902,511 | A | 9/1975 | Jacobs | |
| 4,010,766 | A | 3/1977 | Bowles et al. | |

(Continued)

FOREIGN PATENT DOCUMENTS

| | | |
|---|---|---|
| AT | 006405 U1 | 10/2003 |
| AT | 006546 U1 | 12/2003 |

(Continued)

OTHER PUBLICATIONS

U.S. Appl. No. 15/092,427, filed Apr. 6, 2016, titled "Chip Sorting Devices and Related Assemblies, Components and Methods", to Krenn, 47 pages.
Chipmaster Training handouts from Jan. 1994 (author unknown), 65 pages.
Cover sheet of 1993 video tape describing the Chipmaster (author unknown), 1 page.

(Continued)

*Primary Examiner* — Mark J Beauchaine
(74) *Attorney, Agent, or Firm* — TraskBritt

(57) ABSTRACT

Chip sorting devices may include at least one chip collection tube having at least one of a chip stack alignment cup or a stabilizer positioned over the at least one chip collection tube.

14 Claims, 9 Drawing Sheets

(56) References Cited

U.S. PATENT DOCUMENTS

| | | | |
|---|---|---|---|
| 4,060,093 | A | 11/1977 | Douno |
| 4,098,056 | A | 7/1978 | Ozaki |
| 4,102,110 | A | 7/1978 | Iizuka et al. |
| 4,157,139 | A | 6/1979 | Bjork |
| 4,161,381 | A | 7/1979 | Sciortino |
| 4,164,232 | A | 8/1979 | Nakai et al. |
| 4,209,960 | A | 7/1980 | Deutschländer et al. |
| 4,275,751 | A | 6/1981 | Bergman |
| 4,360,034 | A | 11/1982 | Davila et al. |
| 4,427,389 | A | 1/1984 | D'Andrade |
| 4,531,531 | A | 7/1985 | Johnson et al. |
| 4,543,969 | A | 10/1985 | Rasmussen |
| 4,607,649 | A | 8/1986 | Taipale et al. |
| 4,681,128 | A | 7/1987 | Ristvedt et al. |
| 4,731,043 | A | 3/1988 | Ristvedt et al. |
| 4,775,354 | A | 10/1988 | Rasmussen et al. |
| 4,863,414 | A | 9/1989 | Ristvedt et al. |
| 4,902,263 | A | 2/1990 | Ito et al. |
| 4,966,570 | A | 10/1990 | Ristvedt et al. |
| 5,011,455 | A | 4/1991 | Rasmussen |
| 5,011,456 | A | 4/1991 | Kobayashi et al. |
| 5,022,889 | A | 6/1991 | Ristvedt et al. |
| 5,042,810 | A | 8/1991 | Williams |
| 5,074,434 | A | 12/1991 | Maki |
| 5,141,443 | A | 8/1992 | Rasmussen et al. |
| 5,166,502 | A | 11/1992 | Rendleman et al. |
| 5,207,612 | A | 5/1993 | Wollaston |
| 5,277,651 | A | 1/1994 | Rasmussen et al. |
| 5,406,264 | A | 4/1995 | Plonsky et al. |
| 5,460,295 | A | 10/1995 | Law |
| 5,472,074 | A | 12/1995 | Milcetic |
| 5,531,331 | A | 7/1996 | Barnett |
| 5,538,468 | A | 7/1996 | Ristvedt et al. |
| 5,551,542 | A | 9/1996 | Stockli |
| 5,607,352 | A | 3/1997 | Tani |
| 5,624,308 | A | 4/1997 | Rumbach |
| 5,651,548 | A | 7/1997 | French et al. |
| 5,735,742 | A | 4/1998 | French |
| 5,755,618 | A | 5/1998 | Mothwurf |
| 5,757,876 | A | 5/1998 | Dam et al. |
| 5,770,533 | A | 6/1998 | Franchi |
| 5,781,647 | A | 7/1998 | Fishbine et al. |
| 5,827,117 | A | 10/1998 | Naas |
| 5,836,583 | A | 11/1998 | Towers |
| 5,865,673 | A | 2/1999 | Geib et al. |
| 5,895,321 | A | 4/1999 | Gassies et al. |
| 5,931,732 | A | 8/1999 | Abe et al. |
| 5,933,244 | A | 8/1999 | Kiritchenko |
| 5,947,257 | A | 9/1999 | Schwartz |
| 5,950,796 | A | 9/1999 | Kobayashi |
| 5,957,262 | A | 9/1999 | Molbak et al. |
| 5,957,776 | A | 9/1999 | Hochne |
| 6,021,949 | A | 2/2000 | Boiron |
| 6,030,284 | A | 2/2000 | Frank |
| 6,075,217 | A | 6/2000 | Kiritchenko |
| 6,080,056 | A | 6/2000 | Karlsson |
| 6,099,402 | A | 8/2000 | Abe et al. |
| 6,139,418 | A | 10/2000 | Geib et al. |
| 6,168,001 | B1 | 1/2001 | Davis |
| 6,186,895 | B1 | 2/2001 | Oliver |
| 6,193,599 | B1 | 2/2001 | Kurosawa et al. |
| 6,260,757 | B1 | 7/2001 | Strisower |
| 6,264,109 | B1 | 7/2001 | Chapet et al. |
| 6,283,856 | B1 | 9/2001 | Mothwurf |
| 6,296,190 | B1 | 10/2001 | Rendleman |
| 6,313,871 | B1 | 11/2001 | Schubert |
| 6,318,536 | B1 | 11/2001 | Korman et al. |
| 6,381,294 | B1 | 4/2002 | Britton |
| 6,425,817 | B1 | 7/2002 | Momemy |
| 6,464,584 | B2 | 10/2002 | Oliver |
| 6,506,115 | B1 | 1/2003 | Mothwurt |
| 6,532,297 | B1 | 3/2003 | Lindquist |
| 6,540,602 | B2 | 4/2003 | Adams et al. |
| 6,567,159 | B1 | 5/2003 | Corech |
| 6,572,474 | B2 | 6/2003 | Rudd |
| 6,581,747 | B1 | 6/2003 | Charlier et al. |
| 6,592,445 | B2 | 7/2003 | Lee |
| 6,629,591 | B1 | 10/2003 | Griswold et al. |
| 6,733,388 | B2 | 5/2004 | Mothwurt |
| 6,753,830 | B2 | 6/2004 | Gelbman |
| 6,772,870 | B2 | 8/2004 | Sugai et al. |
| 6,776,702 | B1 | 8/2004 | Ashford et al. |
| 6,976,589 | B2 | 12/2005 | De Raedt et al. |
| 7,004,831 | B2 | 2/2006 | Hino et al. |
| 7,014,554 | B1 | 3/2006 | Fletcher et al. |
| 7,028,826 | B2 | 4/2006 | De Raedt et al. |
| 7,066,335 | B2 | 6/2006 | Aas et al. |
| 7,201,268 | B2 | 4/2007 | DeMeutter et al. |
| 7,244,175 | B2 | 7/2007 | Adams et al. |
| 7,681,708 | B2 | 3/2010 | De Raedt et al. |
| 7,704,133 | B2 | 4/2010 | Adams et al. |
| 7,861,868 | B2 | 1/2011 | Blaha et al. |
| 7,926,638 | B2 | 4/2011 | O'Byrne |
| 7,934,980 | B2 | 5/2011 | Blaha et al. |
| 7,992,720 | B2 | 8/2011 | Blaha et al. |
| 8,006,847 | B2 | 8/2011 | Blaha et al. |
| 8,202,144 | B2 | 6/2012 | Hino et al. |
| 8,298,052 | B2 | 10/2012 | DeRaedt et al. |
| 8,336,699 | B2 | 12/2012 | Blaha et al. |
| 8,393,942 | B2 | 3/2013 | Blaha et al. |
| 8,678,164 | B2 | 3/2014 | DeRaedt et al. |
| 8,757,349 | B2 | 6/2014 | Blaha et al. |
| 9,105,140 | B2 | 8/2015 | Enomoto |
| 2002/0061724 | A1 | 5/2002 | Nomura |
| 2002/0074209 | A1 | 6/2002 | Karlsson |
| 2003/0019716 | A1 | 1/2003 | Sugai et al. |
| 2003/0111395 | A1 | 6/2003 | Aas et al. |
| 2004/0149539 | A1 | 8/2004 | De Raedt et al. |
| 2004/0238320 | A1 | 12/2004 | Hino et al. |
| 2005/0142998 | A1* | 6/2005 | Enomoto ..... G07D 1/00 453/9 |
| 2005/0155838 | A1 | 7/2005 | Raedt et al. |
| 2005/0176360 | A1 | 8/2005 | Abe et al. |
| 2005/0280212 | A1 | 12/2005 | Blaha et al. |
| 2006/0113161 | A1 | 6/2006 | Umeda |
| 2006/0281397 | A1 | 12/2006 | Sanchis Franch et al. |
| 2007/0099553 | A1 | 5/2007 | Blaha et al. |
| 2007/0212996 | A1 | 9/2007 | Ryou |
| 2009/0047899 | A1 | 2/2009 | Adams et al. |
| 2010/0230233 | A1 | 9/2010 | De Raedt et al. |
| 2011/0001290 | A9 | 1/2011 | Blaha et al. |
| 2011/0105002 | A1 | 5/2011 | Blaha et al. |
| 2011/0207390 | A1 | 8/2011 | Blaha et al. |
| 2011/0306284 | A1 | 12/2011 | Blaha et al. |
| 2013/0102236 | A1 | 4/2013 | Blaha et al. |
| 2013/0205723 | A1 | 8/2013 | Blake et al. |
| 2014/0170948 | A1 | 6/2014 | Enomoto |
| 2014/0194045 | A1 | 7/2014 | Fischer et al. |
| 2014/0202825 | A1 | 7/2014 | DeRaedt et al. |
| 2014/0302762 | A1 | 10/2014 | Blaha et al. |
| 2015/0140912 | A1 | 5/2015 | Chein et al. |
| 2015/0302678 | A1 | 10/2015 | Blake et al. |

FOREIGN PATENT DOCUMENTS

| | | | | |
|---|---|---|---|---|
| AT | 007854 | U1 | 10/2005 | |
| CA | 2090073 | A1 | 8/1994 | |
| CA | 2229054 | A1 | 8/1996 | |
| CA | 2229053 | A1 | 10/1996 | |
| DE | 3144327 | A1 | 5/1983 | |
| DE | 4240886 | A1 | 7/1994 | |
| EP | 0424355 | A1 * | 4/1991 | ..... C07D 3/00 |
| EP | 615216 | A2 | 9/1994 | |
| EP | 0424355 | B1 | 11/1994 | |
| EP | 0631260 | B1 | 12/1994 | |
| EP | 0757582 | B1 | 2/1997 | |
| EP | 0806020 | B1 | 12/1998 | |
| EP | 1080348 | B1 | 8/2002 | |
| EP | 0823041 | B1 | 9/2002 | |
| EP | 0950989 | B1 | 9/2003 | |
| EP | 1050024 | B1 | 3/2004 | |
| EP | 2497068 | | 5/2011 | |
| EP | 2960875 | A1 | 12/2015 | |
| FR | 2749093 | B1 | 7/1998 | |

(56) References Cited

FOREIGN PATENT DOCUMENTS

| | | | |
|---|---|---|---|
| FR | 2752078 | A1 | 10/1998 |
| GB | 359036 | A | 10/1931 |
| GB | 720707 | A | 12/1954 |
| GB | 1255492 | A | 12/1971 |
| GB | 1571219 | A | 7/1980 |
| GB | 2061490 | A | 5/1981 |
| GB | 2198274 | A | 6/1988 |
| GB | 2203582 | A | 10/1988 |
| GB | 2254419 | A | 10/1992 |
| GB | 2333632 | A | 7/1999 |
| IT | 1094A001040 | A | 12/1994 |
| WO | 9117842 | A1 | 11/1991 |
| WO | 9211953 | A1 | 7/1992 |
| WO | 9528996 | A1 | 11/1995 |
| WO | 9623281 | A1 | 8/1996 |
| WO | 9634258 | A1 | 10/1996 |
| WO | 9938126 | A1 | 7/1999 |
| WO | 9960353 | A1 | 11/1999 |
| WO | 03049045 | A1 | 6/2003 |
| WO | 03103860 | A1 | 12/2003 |
| WO | 2004009256 | A1 | 1/2004 |
| WO | 2004069431 | A2 | 8/2004 |
| WO | 2008046561 | A1 | 4/2008 |
| WO | 2011051700 | A1 | 5/2011 |

OTHER PUBLICATIONS

Trial installation of Chipmaster at Holland Casinos, report by Christian Pohanka, Sep. 29, 1993, 5 pages.

Huxley's advertisement for Chipmaster: Huxley's count on the Chipmaster deal, ("Casino World" is distributed in the U.S.) Mar. 1994 (author unknown), 1 page.

Show report for Chipmaster in Monte Carlo by Christian Pohanka, Mar. 23, 1993, 4 pages.

Photograph of first Chipmaster installation at Casino Baden (Austria), Jan. 4, 2004 (photographer unknown), 1 page.

Photograph of first Chipmaster installation at Holland Casinos, Jan. 4, 2004 (photographer unknown), 1 page.

Photographs of Chipmaster in Paulson Booth at Apr. 26-27, 1994 Show (photographer unknown), 4 pages.

Photograph of first Chipmaster installation at Valencia (Spain), Jan. 4, 2004 (photographer unknown), 1 page.

Photograph of Chipmaster production at Vicoma, Vienna, Jan. 4, 2005 (photographer unknown), 1 page.

Report from Spain regarding Chipmaster by Christina Pohanka, Sep. 26, 1993, 5 pages.

Visit report Casino Picayo—Valencia—Spain from Sep. 24, 1993, (author unknown), 2 pages.

* cited by examiner

CHIP SORTING DEVICES AND RELATED ASSEMBLIES AND METHODS

TECHNICAL FIELD

The disclosure relates to chip sorting devices and related assemblies, components and methods. In particular, embodiments of the disclosure relate to chip sorting devices, collecting tubes for chip sorting devices, and methods and systems of sorting chips.

BACKGROUND

Given the desire to improve profitability and increase the speed and efficiency of table game play in gaming establishments, there is a need to reduce costs through cost savings and replacement costs due to wear and tear on equipment. Furthermore, given the desire to improve profitability and increase the speed and efficiency of game play such as the game of roulette, in gaming establishments, there is a need to increase the number of rounds that may be played with gaming equipment in a selected amount of time, decrease the amount of work performed by human dealers, etc.

For example, there is a need for improved roulette chip sorting devices, which may have the same or similar profile as existing equipment to avoid retrofitting existing gaming tables and that include adjustable positioning structures to permit limited movement of the device adjacent the gaming table surface. Additionally, it may be desirable to develop improved chip sorting devices having reduced production cost, which may improve efficiency, improve reliability, reduce wear on chips and minimize noise to preserve the casino ambience. Furthermore, it may be desirable to develop improved chip sorting devices that are easily customizable to accommodate varying chip sizes. Finally, it may be desirable to develop improved chip sorting devices that are capable of ensuring proper chip orientation in order to improve reliability of the chip sorting devices.

BRIEF SUMMARY

This summary is provided to introduce a selection of exemplary embodiments in a simplified form. These exemplary embodiments are described in further detail in the detailed description below. This summary is not intended to identify key features or essential features of the claimed subject matter, nor is it intended to be used to limit the scope of the claimed subject matter.

Some embodiments of the present disclosure include a chip sorting device. The chip sorting device may include a chip conveyor unit having at least one chip well for transporting chips and at least one chip collection tube for receiving at least some of the chips from the chip conveyor unit. The at least one chip collection tube may have a chip stack alignment cup for containing the at least some of the chips therein, at least a portion of the chip stack alignment cup may have an inner lateral dimension that is larger than a dimension of the at least some of the chips to enable a lateral position of each of the at least some of the chips in a chip stack to vary after the at least some of the chips have been received from the chip conveyor unit.

Some embodiments of the present disclosure include a chip sorting device. The chip sorting device may include at least one chip collection tube for receiving chips. The at least one chip collection tube may have an opening through which at least some of the chips enter the at least one chip collection tube from the chip conveyor unit and at least one stabilizer positioned over the at least one chip collection tube. The at least one stabilizer is configured to at least partially restrict the opening to direct at least one chip into the at least one chip collection tube.

Some embodiments of the present disclosure include a chip sorting device. The chip sorting device may include at least one chip collection tube for receiving chips. The at least one chip collection tube may have a chip stack alignment cup for containing at least some of the chips therein and at least one insert configured to be received in the chip stack alignment cup. The at least one insert is sized and configured to conform an inner cross-sectional area of the chip stack alignment cup to a corresponding cross-sectional area of a chip to be received in the chip stack alignment cup.

Some embodiments of the present disclosure include a chip sorting device. The chip sorting device may include at least one chip collection tube for receiving at least some of the chips from the chip conveyor unit. The at least one chip collection tube may have a chip stack alignment cup for containing the at least some of the chips therein and a plunger configured to move both the chip stack alignment cup and the chip stack from a first position to a second position. The chip sorting device is configured to move only the plunger past the second position while the chip stack alignment cup remains at the second position.

BRIEF DESCRIPTION OF THE DRAWINGS

The present disclosure may be understood more fully by reference to the following detailed description of example embodiments, which are illustrated in the accompanying figures.

DETAILED DESCRIPTION

Figure 1:
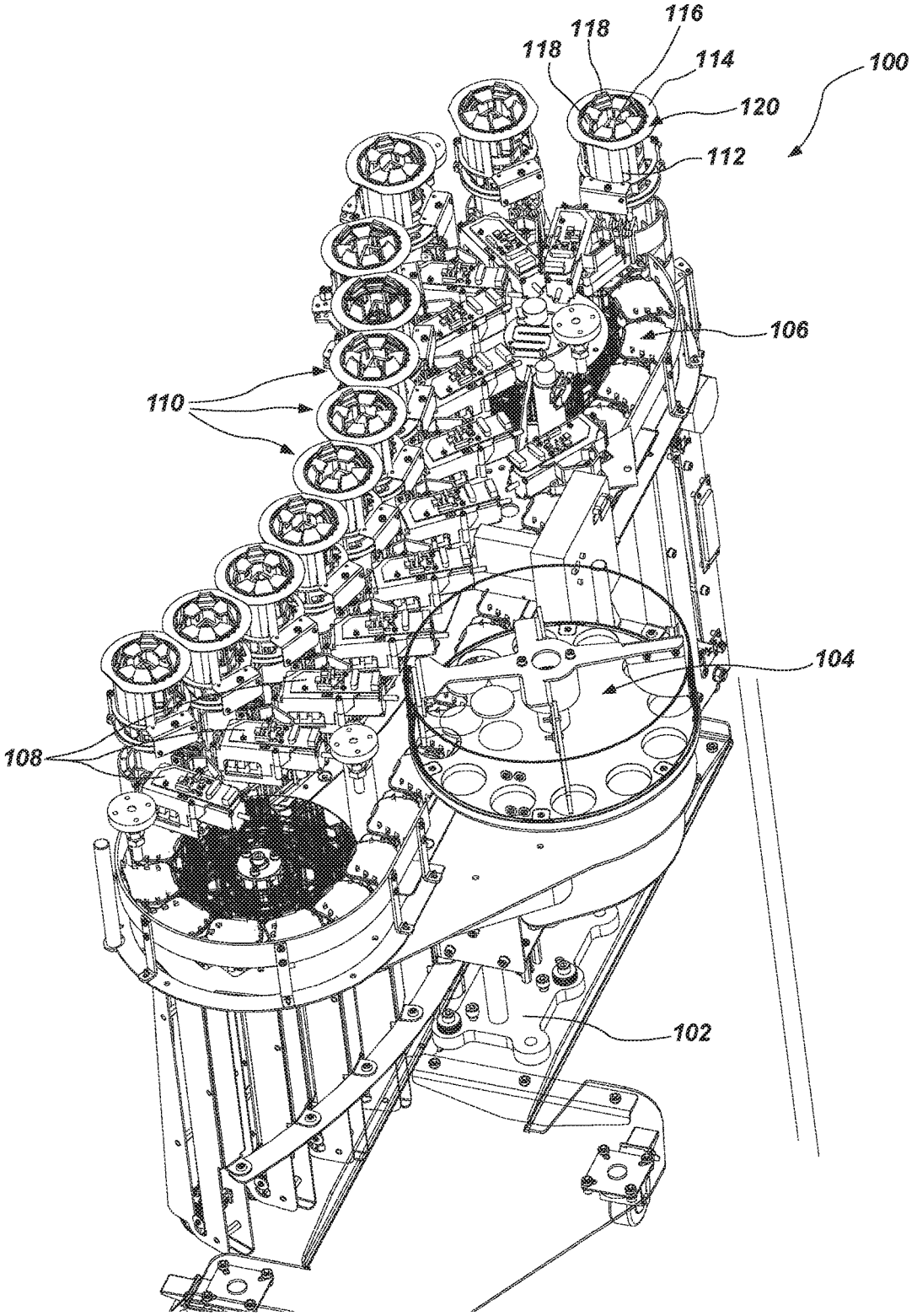
FIG. 1 shows a perspective view of a chip sorting device, according to an embodiment of the present disclosure, with portions of housings removed to show interior components of the chip sorting device.

The illustrations presented herein are not meant to be actual views of any particular chip sorting device, or component thereof, and may be merely simplified schematic representations employed to describe illustrative embodiments of the disclosure. The drawings are not necessarily to scale.

Some embodiments of the present disclosure may include chip sorting devices having chip collection tubes including a chip receiver (e.g., a chip stack alignment cup). Such a chip receiver may act to contain a stack of chips therein during loading and/or when the stack of chips is lifted to a surface of a gaming table. Chip collection tubes may include features for aligning the stack of chips in the chip receiver, which may enable the chips to be loosely aligned. Chip collection tubes may include a stabilizer for ensuring that chips loaded into the chip collection tube remain in a desired orientation.

As used herein, any relational term, such as "first," "second," "over," "beneath," "top," "bottom," "underlying," "up," "down," etc., is used for clarity and convenience in understanding the disclosure and accompanying drawings, and does not connote or depend on any specific preference, orientation, or order, except where the context clearly indicates otherwise. For example, these terms may refer to an orientation of elements of the chip sorting device relative to a surface of a table beneath which the chip sorting device may be positioned and operated (e.g., as illustrated in the figures).

As used herein, the terms "vertical" and "horizontal" may refer to a drawing figure as oriented on the drawing sheet, and are in no way limiting of orientation of an apparatus, or any portion thereof, unless it is apparent that a particular orientation of the apparatus is necessary or desirable for operation in view of gravitational forces. For example, when referring to elements illustrated in the figures, the terms "vertical" or "horizontal" may refer to an orientation of elements of the chip sorting device relative to a surface of a table beneath which the chip sorting device may be positioned and operated.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

A perspective view of a chip sorting device 100 with portions of one or more housings of the chip sorting device 100 removed to show interior components of the chip sorting device 100 is shown in FIG. 1. The chip sorting device 100 may be positioned beneath a table surface (e.g., a gaming table surface) of a table (e.g., a gaming table) and may be configured to deliver sorted chips to the table surface and/or receive chips to be sorted from the table surface. As shown, the chip sorting device 100 may comprise a frame structure 102, a chip hopper 104, a chip conveyor unit 106, a plurality of chip ejection units 108, and a plurality of chip collection tubes 110. The chip hopper 104 may be oriented at least partially over the chip conveyor unit 106 and any chips sorted by the chip hopper 104 may be moved (e.g., dropped) from the chip hopper 104 onto the chip conveyor unit 106. The plurality of chip ejection units 108 and the plurality of chip collection tubes 110 may be disposed adjacent to the chip conveyor unit 106 along a length of the chip conveyor unit 106. An upper rim 120 of the chip collection tubes 110 may be configured to be at least substantially flush with a table surface of the table.

Figure 2:
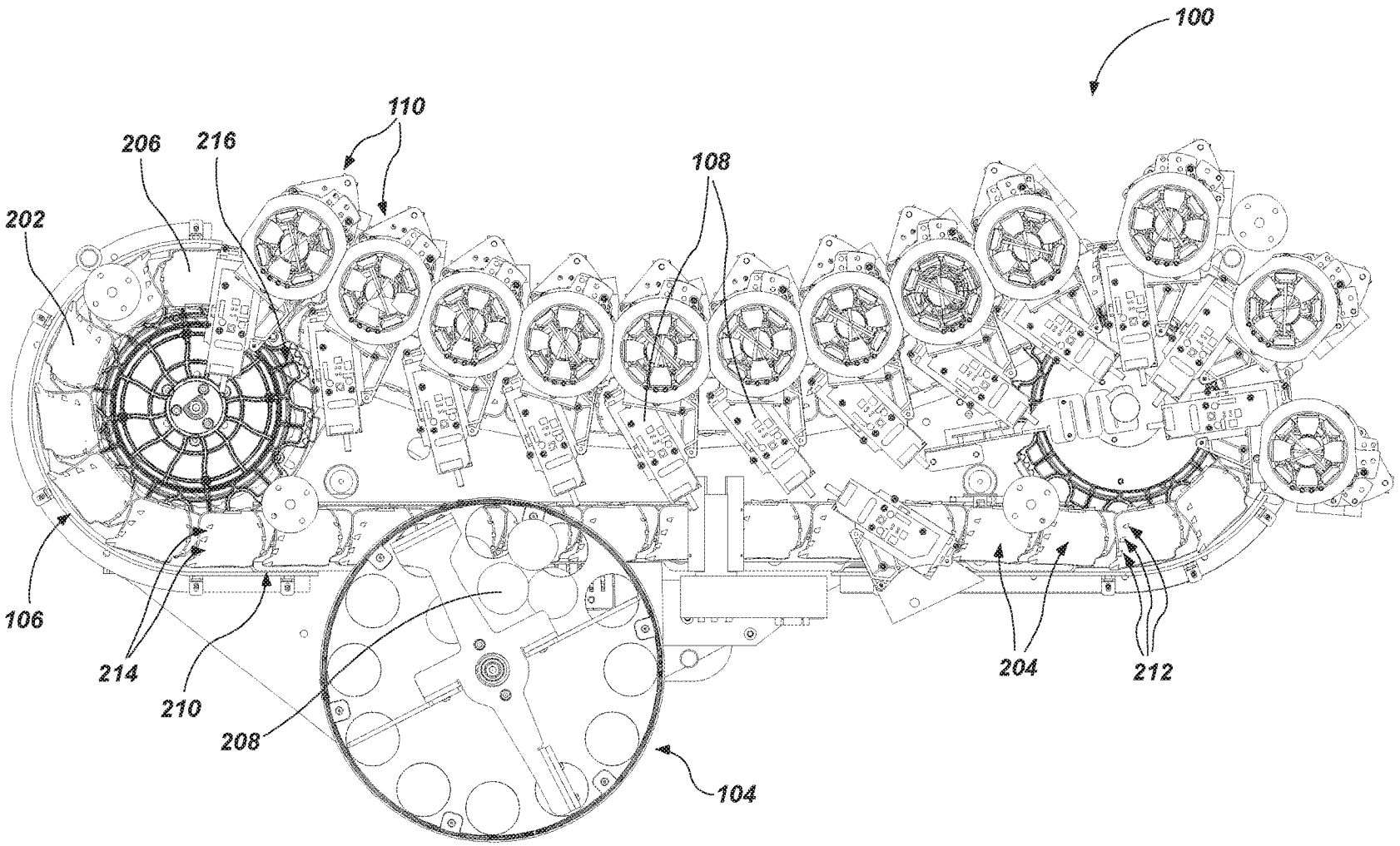
FIG. 2 shows a top elevation of the chip sorting device of FIG. 1 having additional portions of housings removed to show interior components of the chip sorting device.

FIG. 2 is a top elevation of the chip sorting device 100 with portions of housings removed to more clearly show interior components of the chip sorting device 100. The chip conveyor unit 106 may include an articulated conveyor 202, which may be arranged along a fixed path within the chip sorting device 100. The articulated conveyor 202 may comprise a plurality of articulated link units 204 and each link unit 204 may include a chip well 206 for carrying at least one chip 208. Each chip well 206 may be at least partially defined by and positioned adjacent to segmented guide walls 210 comprised of a plurality of wall segments 212, and a plurality of channels 214 may be defined between wall segments 212 of the plurality of wall segments 212.

The fixed path of the articulated conveyor 202 may enable each link unit 204, and any chips 208 that may be carried thereby, to travel along a generally straight path (i.e., a substantially linear path) when proximate to the chip hopper 104. The fixed path may enable each link unit 204, and any chips 208 that may be carried thereby, to travel along a generally curved path when proximate to the plurality of chip ejection units 108 and corresponding plurality of chip collection tubes 110. In some embodiments, a drive belt 216 of the chip conveyor unit 106 may be at least partially formed from a nonmetal material (e.g., not a metal chain drive belt). For example, the drive belt 216 may be formed from a flexible polymer material, internally fiber-reinforced, as desirable, that may require little to no maintenance (e.g., may not require regularly scheduled lubrication).

Figure 3:
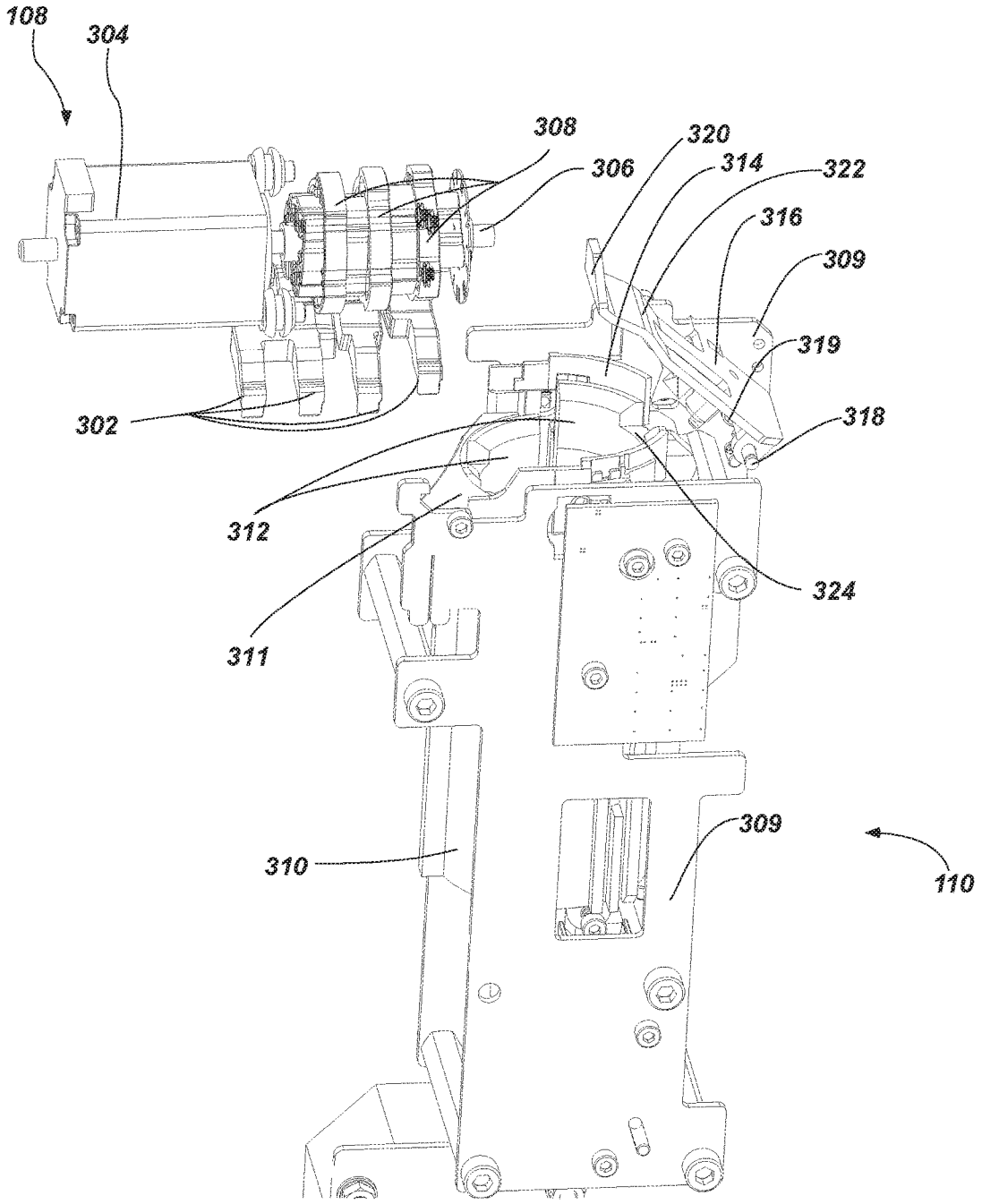
FIG. 3 shows a perspective view of a portion of the chip collection tube of the chip sorting device of FIG. 1.

FIG. 3 is a perspective view of a portion of a chip collection tube 110 including a chip ejection unit 108 of a chip sorting device (e.g., the chip sorting device 100 shown in FIGS. 1 and 2). Referring to FIGS. 2 and 3, in some embodiments, the chip sorting device 100 may include chip ejections units 108 as described in U.S. Pat. No. 8,336,699 to Blaha et al. and U.S. patent application Ser. No. 15/092,427, to Peter Krenn, filed Apr. 6, 2016, now U.S. Pat. No. 9,836,909, issued Dec. 5, 2017, the disclosure of each of which is incorporated in its entirety by this reference. For example, each chip ejection unit 108 may include finger members 302 sized and positioned to be positioned adjacent and/or between one or more wall segments 212 of the plurality wall segments 212 and into the plurality of channels 214. In other words, the finger members 302 of the chip ejection units 108 may be positioned axially over the plurality of channels 214 and may be selectively movable into the plurality of channels 214. The finger members 302 may operate in the same manner as the finger members 302 of the chip ejection units described in U.S. Pat. No. 8,336,699 to Blaha et al. to eject selected chips 208 into selected chip collection tubes 110 according to different chip classifications. For example, each chip ejection unit 108 of the plurality of chip ejection units 108 may include a motor 304, such as one of a stepper motor and a servomotor, attached to a cam shaft 306 supporting a plurality of cams 308, such as tri-lobe cams, thereon. The cams 308 may be oriented to move each of the finger members 302 from a first position to a second position, and back to the first position, in a sequence by rotation of the cam shaft 306 with the motor 304. For example, the cams 308 may be oriented to sequentially lower the finger members 302 into alignment with the plurality of channels 214 to block a pathway of a chip 208 being transported in a chip well 206 of the chip conveyor unit 106 in order to move the chip 208 toward a respective chip collection tube 110.

As depicted, the chip collection tube 110 may include a frame assembly 309 disposed on at least on side of a chip receiver 310 (e.g., two frame members coupled about the chip receiver 310) where one or more chips 208 may be received into the chip collection tube 110 from the chip conveyor unit 106.

The chip receiver 310 (e.g., a movable chip stack alignment cup) may be mounted (e.g., slidably mounted) to the frame assembly 309. An upper plate 311 may be positioned on the frame assembly 309 and may define an opening through which chips 208 are received from the chip conveyor unit 106 to be placed in the chip receiver 310.

In some embodiments, an upper portion of the chip receiver 310 may be positioned as a backstop 314 for chips 208 placed in the chip receiver 310. For example, a portion of the chip receiver 310 positioned relatively further away from the chip conveyor unit 106 may extend beyond another portion of the chip receiver 310 to define the backstop 314. Chips 208 traveling over the upper plate 311 may pass over the lower, front portion of the chip receiver 310 and may contact the backstop 314 in order to halt movement of the chip 208 and to position it in the chip receiver 310.

In some embodiments, one or more removable inserts 312 (e.g., two removable inserts) may be disposed in the chip receiver 310. As depicted, two semicircular inserts 312 may be disposed in the chip receiver 310 in order to define a relatively smaller annular cross-sectional area in the chip receiver 310. Such inserts 312 may be utilized to adjust the size of the opening in the chip receiver 310 (e.g., a cross-sectional area) to accommodate different sized chips 208. In some embodiments, the one or more of the inserts 312 may include a raised portion similar to the backstop 314. In some embodiments, the inserts 312 may be configured to be entirely removed from the chip receiver 310 (e.g., where the inserts 312 are not coupled to and/or are free of the structure of the chip receiver 310).

In such embodiments, the chip collection tubes 110 of the present disclosure may provide an advantage by removing a need to have multiple different sized collection tubes on a single chip sorting device 100 in order to accommodate differing sized chips 208. Furthermore, the chip collection tubes 110 of the present disclosure may provide an advantage of negating a need to disassemble chip sorting devices and exchange collection tubes with different collection tubes in order to accommodate different size chips 208. Moreover, the chip collection tubes 110 of the present disclosure may enable a chip sorting device 100 to be used for more than one chip size such that the chip sorting device 100 is not limited to a certain size of chip 208. The chip collection tubes 110 of the present disclosure may be used as universal collection tubes that can accommodate a wide range of chip sizes. A chip sorting device 100 utilizing the chip collection tubes 110 of the present disclosure may be used in a wider variety of applications (e.g., games) without requiring any components except for the chip cups 110 to be exchanged. Furthermore, chip sorting devices 100 utilizing the chip collection tubes 110 of the present disclosure may quickly be switched from sorting certain chip sizes to sorting different chip sizes as compared to conventional chip sorting devices currently available. Such chip collection tubes 110 increase the range of chips 208 being sorted and, as a result, the range of applications (e.g., games) that can be administered at a table to which a chip sorting device 100 is positioned under. Moreover, the chip collection tubes 110 of the present disclosure may reduce costs in producing and manufacturing chip sorting devices 100 for sorting mixtures of chips 208 having differing sizes because different chip collection tubes for different sizes of chips 208 will not have to be produced and manufactured. Rather, a plurality of the chip collection tubes 110 of the present disclosure can be used and each adjusted as needed to accommodate the different sizes of chips 208. Chip sorters of the present disclosure may be adapted to accommodate a different size chip if the casino operator changes chip vendors and the size of the new chips is different.

As depicted, the collection tube 110 may include a stabilizer 316 (see FIG. 4) positioned over the chip receiver 310. For example, the stabilizer 316 may be a movable flap positioned at an upper end of the chip receiver 310. In some embodiments, the stabilizer 316 may be coupled at a first end to a shaft 318 and may rotate about the shaft 318. The stabilizer 316 may rotate between a first, lowered position (see FIG. 4) where the stabilizer 316 is positioned over (e.g., directly over extending in a plane transverse or perpendicular to the length of the chip receiver 310 and the opening extending therethrough (e.g., perpendicular to the height of the chips 208 stacked in the chip receiver 310) and a second position (see FIGS. 3 and 5) where the stabilizer 316 is spaced from the chip receiver 310 (e.g., not blocking the opening the in the chip receiver 310).

The stabilizer 316 may include an upturned front portion 320 on a second side of the stabilizer 316. When the stabilizer 316 is positioned over the chip receiver 310, the upturned front portion 320 is configured to contact the chips 208 as they are directed into the chip receiver 310. In some embodiments, the stabilizer 316 may include a raised middle portion 322. The raised middle portion 322 of the stabilizer 316 may enable chips 208 in the chip receiver 310 to be viewed. For example, the raised middle portion 322 of the stabilizer 316 may enable an upmost chip 208 in the chip receiver 310 to be detected by a sensor 319 to verify the chip 208 is in an expected position.

In some embodiments, the chip receiver 310 may include a cutout 324 for receiving a portion of the stabilizer 316 when the stabilizer 316 is positioned over the chip receiver 310.

Figure 4:
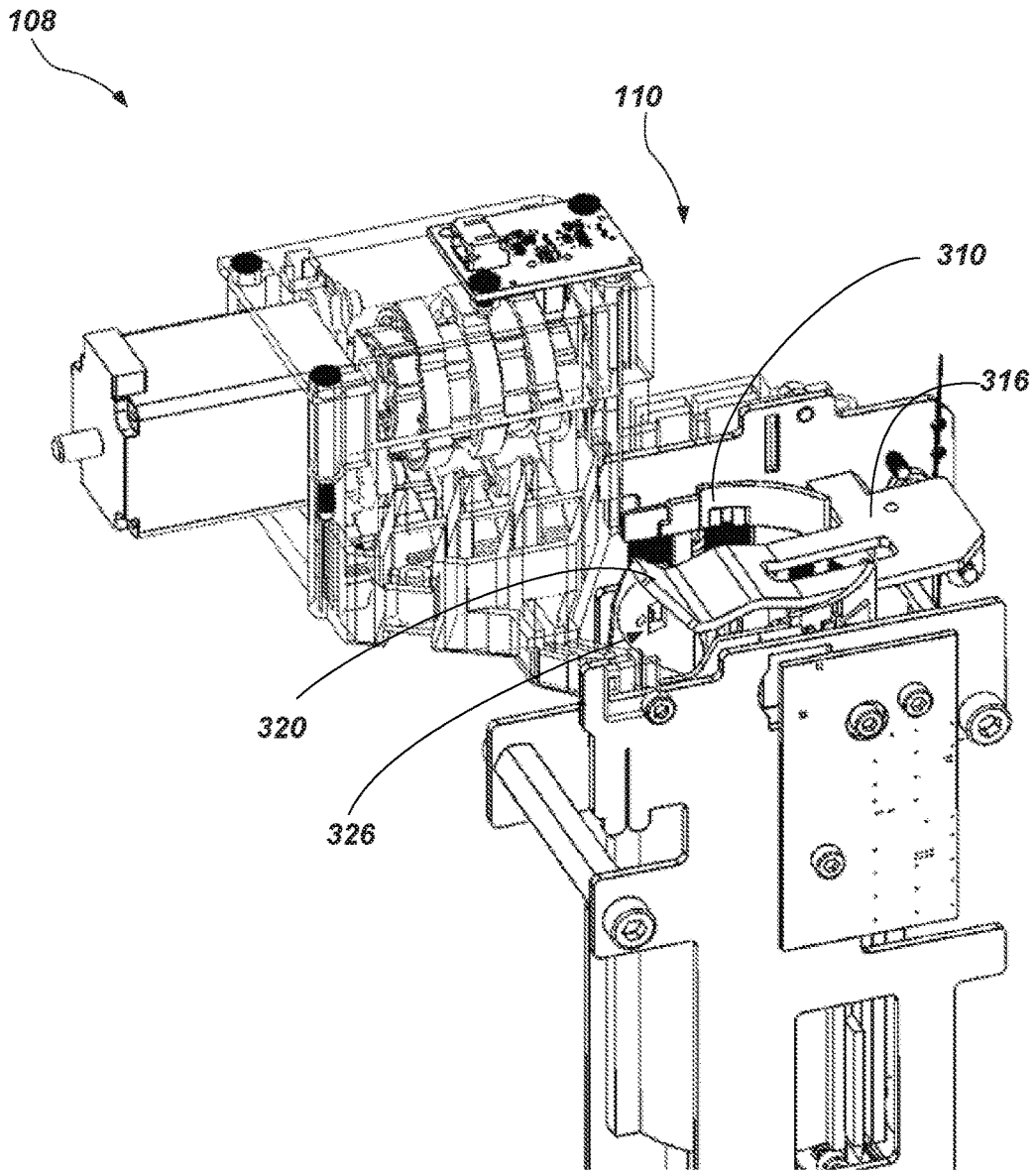
FIG. 4 is another perspective view of a portion of the chip collection tube of FIG. 3 with a stabilizer of the chip ejection unit in a lowered positioned.

FIG. 4 is another perspective view of a portion of the chip ejection unit 108 of FIG. 3 with the stabilizer 316 in a lowered position over the chip receiver 310. As shown in FIG. 4, when the stabilizer 316 is positioned over the chip receiver 310, the upturned front portion 320 is configured to contact any chips that are positioned above (e.g., elevated over) an opening 326 formed between a leading side of the chip receiver 310 (e.g., a portion positioned proximate the upper plate 311) and the stabilizer 316 as the chips are directed into the chip receiver 310. For example, the inverted slanted surface of the upturned front portion 320 gradually moves the chips (e.g., without substantially rotating the chip) downward so the chips may be positioned in the chip receiver 310 over a floor of the receiver (e.g., a movable plunger, discussed below) and/or over one or more chips already present in the receiver in a chip stack.

Figure 5:
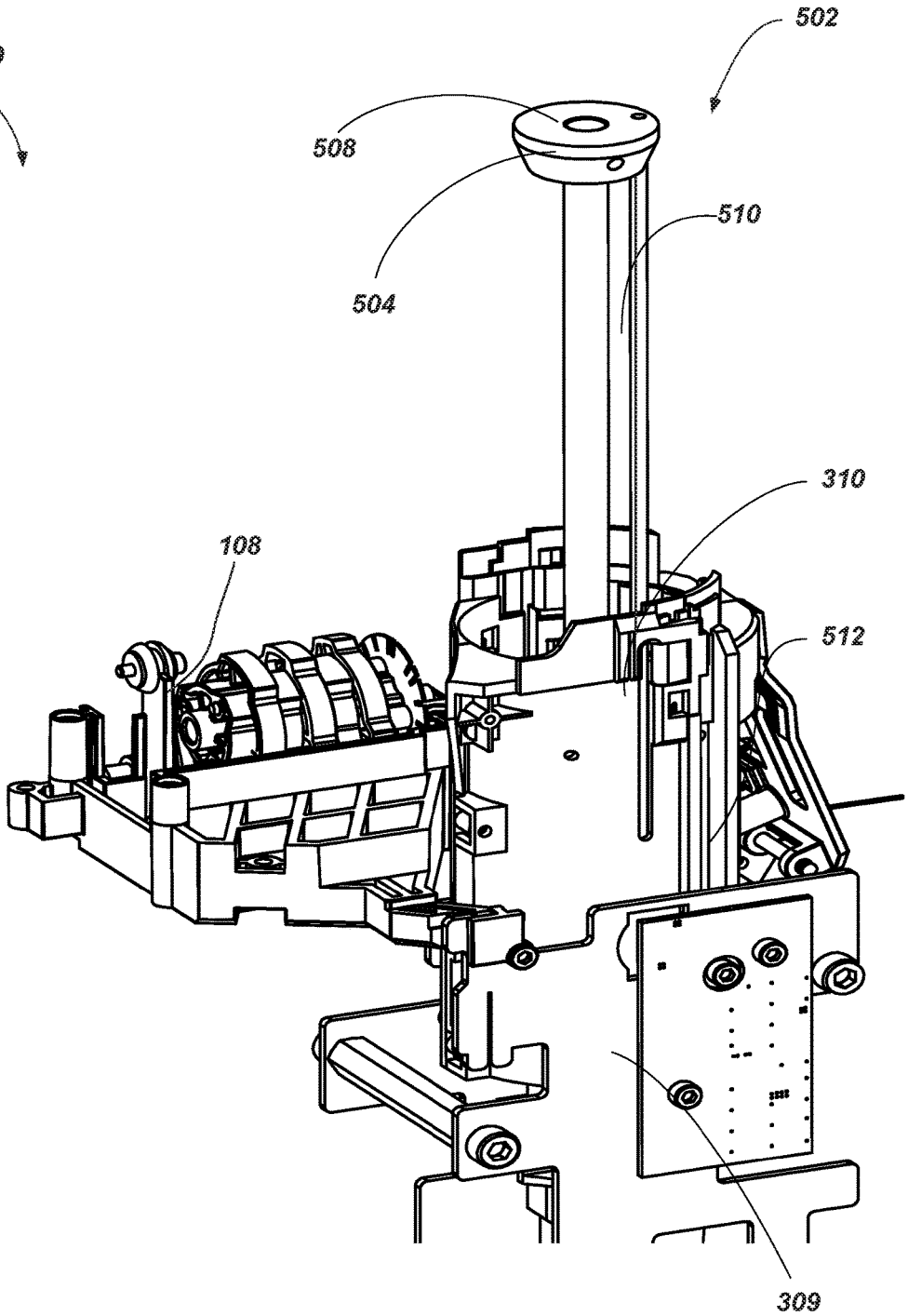
FIG. 5 is another perspective view of a portion of the chip collection tube of FIG. 3 including a plunger assembly in an extended position.

FIG. 5 is another perspective view of a portion of the chip ejection unit 108 of FIGS. 3 and 4 including a plunger assembly 502 in an extended position. Referring to FIG. 5, the plunger assembly 502 may include a plunger 504, which may be movably coupled to the chip collection tube 110 in order to move the plunger 504 between an extended position (as shown) and a retracted position where a head portion 508 of the plunger 504 is positioned within the chip receiver 310. An example of actuation mechanism for a plunger assembly is disclosed, for example, in the above incorporated by reference, U.S. patent application Ser. No. 15/092,427, now U.S. Pat. 9,836,909, issued Dec. 5, 2017. The head portion 508 may be positioned over and attached to an elongated portion 510. The head portion 508 may be connected to a longitudinal end of the elongated portion 510.

The plunger assembly 502 may cause the plunger 504 of the plunger assembly 502 to pass back and forth through a longitudinal length of the chip collection tube 110. In some embodiments, the plunger 504 of the plunger assembly 502 may pass through the interior of the chip collection tube 110 and push any chips 208 (FIG. 2) that might be collected in the chip collection tube 110 up to a table surface of a table which the chip sorting device 100 (FIG. 1) may be positioned under. In some embodiments, the plunger assembly 502 may be pneumatically actuated and/or electronically actuated to cause the plunger 504 to pass through the interior of the chip collection tube 110.

The chip receiver 310 may be moved (e.g., along tracks 512 that pair with complementary tracks of the frame assembly 309) with the plunger assembly 502 in order to contain the chips. In some embodiments, interaction between the tracks 512 and the complementary tracks of the frame assembly 309 may be configured to limit the extended position of the chip receiver 310. For example, one of the tracks 512 and the complementary tracks of the frame assembly 309 may comprise a U-shape configured to stop the chip receiver 310 at its uppermost position.

The stabilizer 316 (see FIGS. 3 and 4) may be moved (e.g., rotated) to a position where the stabilizer 316 is clear of a travel path of the chip receiver 310 so the chip receiver 310 may be moved upward past the stabilizer 316.

In some embodiments, the plunger assembly 502 may act to move the chip receiver 310 with the plunger 504, as discussed below. As depicted, the chip receiver 310 may only travel a distance less than a distance that the plunger 504 travels. For example, the chip receiver 310 may only travel to a position below the table surface of the table, while the plunger 504 extends at least to (e.g., flush with) the table surface of the table and beyond the chip receiver 310.

When the chip receiver 310 is in the upward or extended position, the chip receiver 310 may act to block the chip insertion opening 326 defined between the leading side of the chip receiver 310 and the upturned front portion 320 of the stabilizer 316, as shown in FIGS. 3 and 4.

Figure 6:
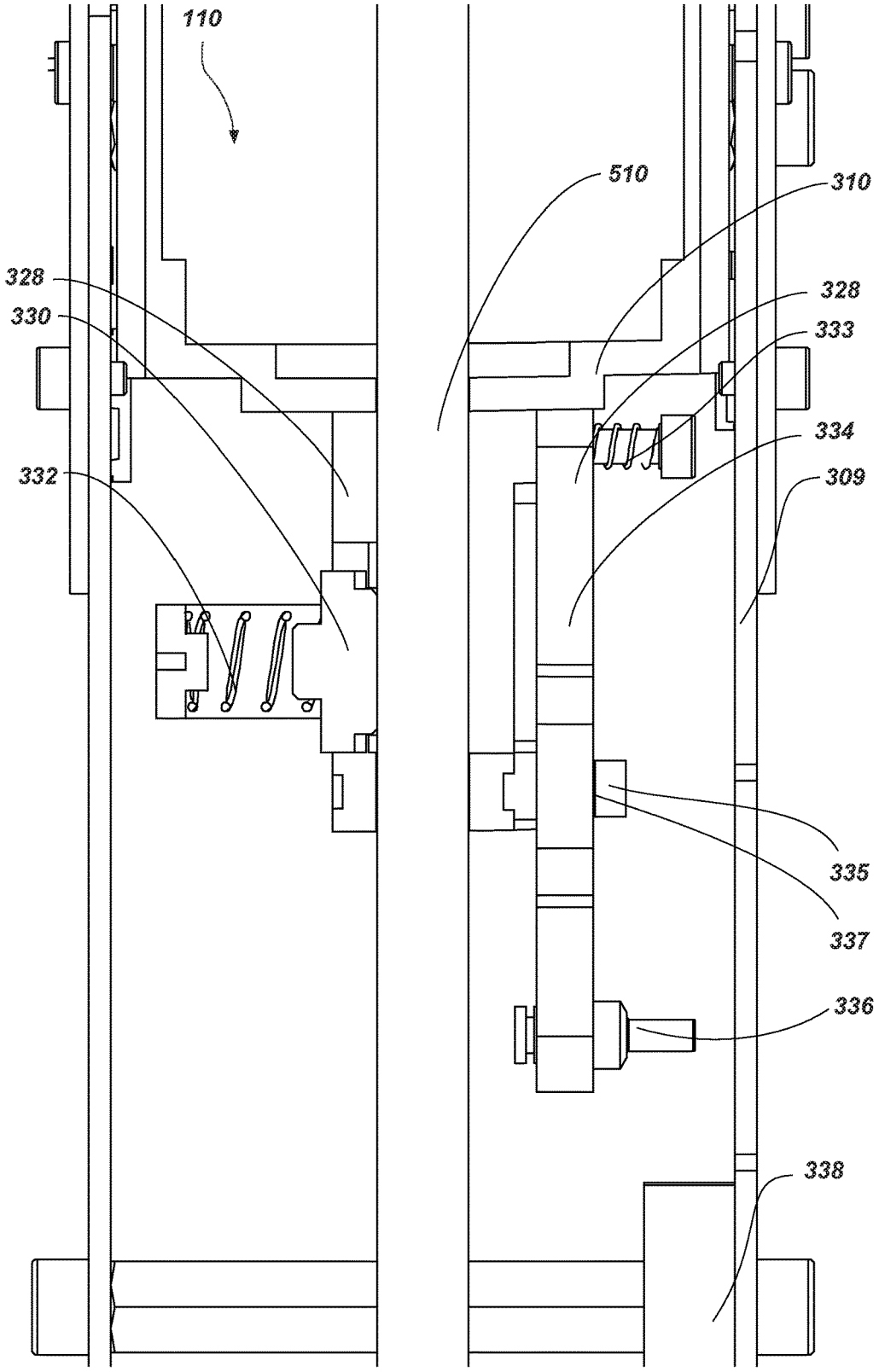
FIG. 6 is a partial cross-sectional view of a portion of the chip collection tube of FIG. 3.

FIG. 6 is a partial cross-sectional view of a portion of the chip collection tube 110 of FIGS. 3 through 5. As shown in FIG. 6, the chip receiver 310 may be coupled to a portion of the plunger assembly 502 (FIG. 5) (e.g., the elongated member 510). For example, chip receiver 310 may include a lower coupling portion 328 coupled to the elongated member 510. The elongated member 510 may extend though the chip receiver 310 in order to position the plunger 504 (FIG. 5) within the chip receiver 310.

The lower coupling portion 328 may be selectively coupled to the elongated member 510 such that the chip receiver 310 moves in union with the elongated member 510 when the plunger assembly 502 (FIG. 5) moves between the extended position and the retracted position. The lower coupling portion 328 may selectively couple to the elongated member 510 such that the chip receiver 310 only moves with the elongated member 510 through a portion of the stroke (e.g., travel path, linear travel distance) of the elongated member 510. For example, the lower coupling portion 328 may selectively couple to the elongated member 510 with a movable coupling (e.g., a translatable coupling, a slidable coupling) defined with a pin portion 330 that is forced (e.g., biased with, for example, a spring 332) into contact with the elongated member 510. In such a configuration, the pin portion 330 will contact the elongated member 510 and the elongated member 510 and the chip receiver 310 will move in unison. However, when a force is applied to the chip receiver 310 that overcomes the biasing force of the spring 332 into the elongated member 510 (and the surface friction between the pin portion 330 and the elongated member 510), the chip receiver 310 will begin to move relative to (e.g., slide along) the elongated member 510.

In some embodiments, such a force may be applied to the chip receiver 310 with a track and track follower feature. For example, a pin plate 334 including at least one follower (e.g., a follower pin 336) may be coupled to (e.g., rotatably coupled with pin 335, or may be formed integrally with) the lower coupling portion 328 of the chip receiver 310. In some embodiments, the pin plate 334 may be movably coupled to the lower coupling portion 328, for example, with one or more pins 333, 335 and/or fasteners. In some embodiments, one pin 335 may be positioned within an enlarged slot 337 that enables the pin plate 334 to move (e.g., rotate back and forth relative to a track plate 338 (see also FIG. 7) in which the pin 336 is received. In some embodiments, the pin plate 334 may be adjustably coupled to the lower coupling portion 328 of the chip receiver 310 to enable adjustment between the pin plate 334 and a track plate 338.

Figure 7:
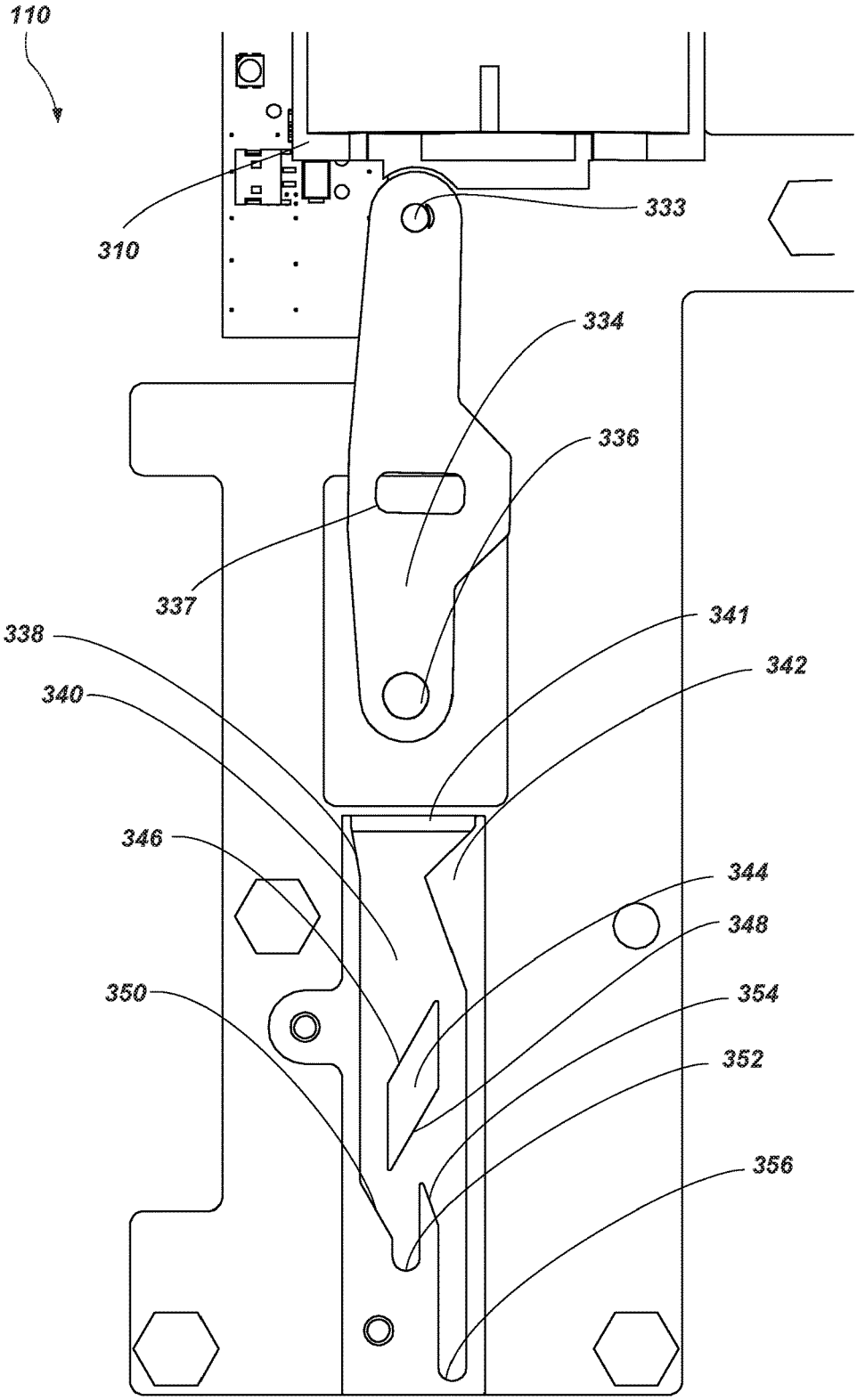
FIG. 7 is an elevational view of a track plate of the chip collection tube of FIG. 3 showing an example embodiment of a track of the track plate used to control movement of the chip receiver.

FIG. 7 is an elevational view of the track plate 338 of the chip collection tube 110 showing an example embodiment of at least one track 340 of the track plate 338 used to control movement of the chip receiver 310. As shown in FIG. 7, the track plate 338 may define the track 340 (e.g., the track 340 may be formed in the track plate 338). The track 340 may include an open upper end 341 where the follower pin 336 is unconstrained (e.g., and may travel free of the track 340). As discussed above, the tracks 512 and the complementary tracks of the frame assembly 309 may prevent the chip receiver 310 from continuing to move upwards with the elongated member 510 (e.g., moving to a position higher than that shown in FIG. 5).

Referring to FIG. 7, the track 340 may include a ramp 342 at the open upper end 341 that may urge the pin 336 toward a midline of the track 340. Moving downward in a direction away from the chip receiver 310 (FIG. 6), an obstruction 344 may be defined in the track 340 with another ramp 346 for moving the pin 336 toward a side of the track 340 above a first lower stop 352. Another ramp 350 may be positioned to urge the pin 336 to the first lower stop 352 after the pin 336 has cleared the obstruction 344.

Referring to FIGS. 4 and 7, at the first lower stop 352, the chip receiver 310 may be in a first lower position where the chip receiver 310 has moved upward from the position shown in FIG. 4. In such a position, the chip insertion opening 326 is blocked by the chip receiver 310, which is moved upwards, thereby, not allowing any chips to be received in the chip receiver 310 when it is in the first lower position.

Referring to FIGS. 4, 5, 6, and 7, the track 340 may include a second lower stop 356 that positions the chip receiver 310 in a second lower position (e.g., as shown in FIG. 4). As depicted, in order to move from the first lower stop 352 to the second lower stop 356, the pin 336 may be required to be moved back upward (e.g., by moving the elongated member 510 upward) and then moved back downward to the second lower stop 356. The track 340 may include another ramp 352 to guide the pin 336 into the second lower stop 356. As indicated in FIG. 4, in the second lower position, the chip insertion opening 326 is open, thereby, allowing chips to be received in the chip receiver 310.

From the second lower stop 356, the pin 336 may be moved upward and may deflect off of ramp 348 on the obstruction 344 and ramp 342 in order to once again travel through the open upper end 341 in order to position the chip receiver 310 in its highest position (e.g., as shown in FIG. 5).

Figure 8:
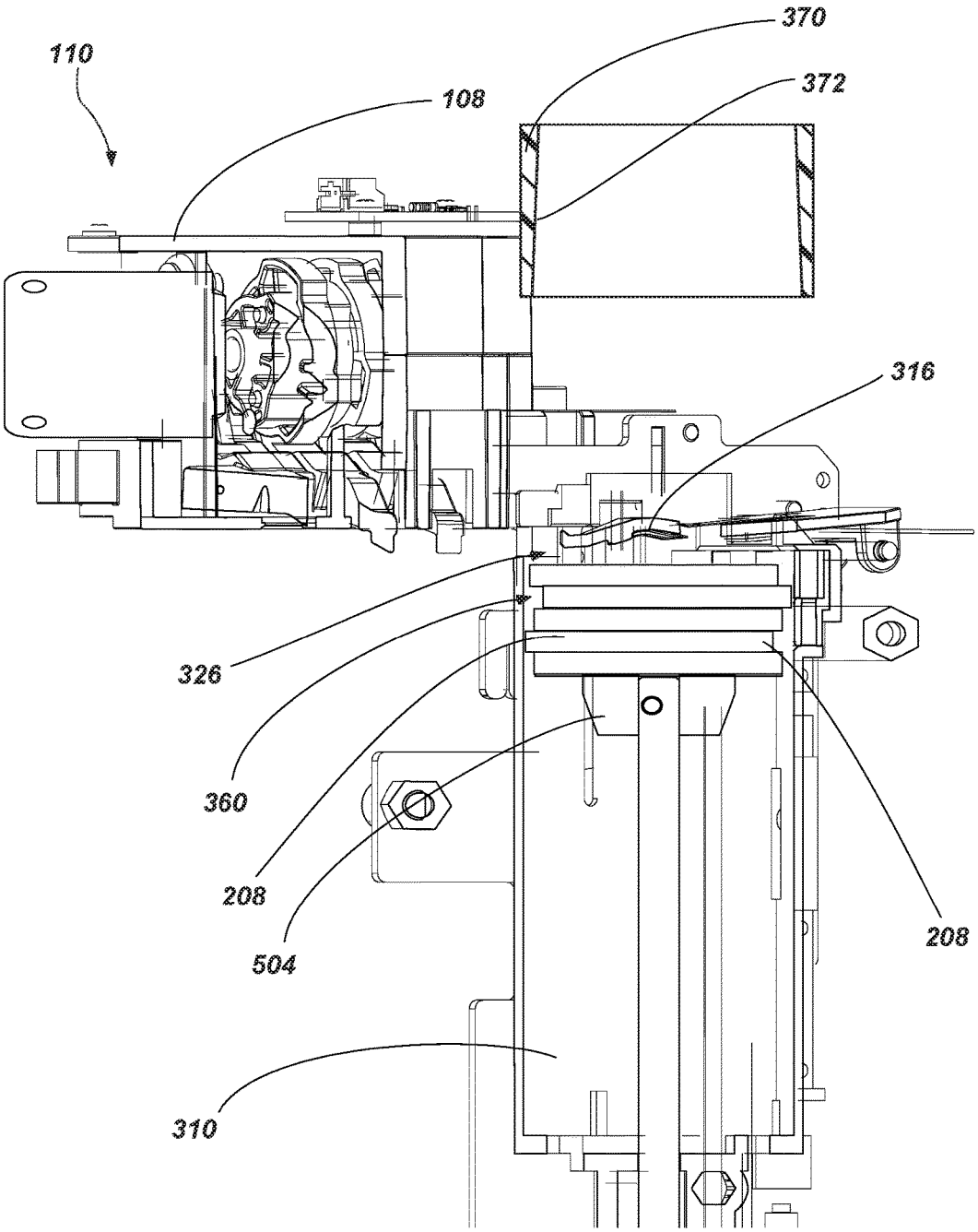
FIG. 8 is a partial cross-sectional view of a portion of the chip collection tube of FIG. 3.

FIG. 8 is a partial cross-sectional view of a portion of the chip collection tube 110 of FIG. 3. As shown in FIG. 8, an internal cross-sectional area of the chip receiver 310 may be sized larger than a cross-sectional area of the chips 208 (e.g., a major face surface of the chips 208 extending between lesser sides, for example, rounded sides, of the chips 208). For example, the chip receiver 310 may be sized with a dimension (e.g., diameter) to provide open space 360 (e.g., clearance around one or more lateral sides of the chips 208).

In such an embodiment, the chips 208, stacked on the plunger 504, may be loosely vertically stacked in the chip receiver 310 such that portions of a chip 208 may overhang an adjacent chip 208 due to the enlarged cross-sectional area of the chip receiver 310. In some embodiments, the dimension of the chip receiver 310 may be 5%, 10%, 15%, 20%, 25%, or more larger than a corresponding dimension of the chips 208.

In some embodiments, as noted above, the removable inserts 312 (FIG. 3), where implemented, may define the inner cross-sectional area.

As chips are inserted into the chip receiver 310 (e.g., with the chip ejection unit 108) through the opening 326 formed between the chip receiver 310 and the stabilizer 316, the chips 208 are stacked over the plunger 504 within the chip receiver 310. In some embodiments, the plunger 504 may be moved incrementally downward as chips 208 are received over the plunger 504 in a stack of chips 208 within the chip receiver 310. For example, the plunger 504 may be moved downward incrementally about a distance equal to the height or thickness of the chip 208 in order retain a substantially constant distance between the uppermost chip 208 and the stabilizer 316 for receiving additional chips 208 through the opening 326.

As the chip receiver 310 is moved upward with the plunger 504 (e.g., as shown in FIG. 5), the chip receiver 310 may act to at least partially contain the chips 208 (e.g., in a stack, in a loosely vertically-aligned stack) as the chips 208 are moved upward toward a surface of the table.

Referring back to FIG. 1, the chip outlet portion 112 of the chip collection tube 110 may include an upper rim 114 and a chip outlet hole 116. The chip outlet portion 112 may be oriented at an upper (e.g., an uppermost) portion of the chip collection tube 110 and may be positioned proximate a table surface of a table to which the chip sorting device 100 (FIG. 1) may be positioned beneath. The upper rim 114 may define the chip outlet hole 116 and may include an upper surface 120 configured to be at least substantially flush with the table surface of the table. One or more flanges 118 may extend at least partially across the chip outlet hole 116 and may open and allow chips 208 (FIG. 2) to pass through the chip outlet hole 116 when the plunger 504 (FIG. 5) of the plunger assembly 502 (FIG. 5) pushes the chips 208 (FIG. 2) up to the table surface.

Referring to FIGS. 1 and 8, when the loosely vertically stacked chips 208 are moved to the table surface with the plunger assembly 502 (FIG. 5), a centering mechanism having a reduced dimension (e.g., a gradually reduced diameter) of the chip collection tube 110 may act to substantially vertically align the stack of chips 208 (e.g., where lateral sides of each of the chips 208 are positioned substantially in the same vertical plane). For example, a centering feature 370 may be positioned between the chip receiver 310 and the chip outlet portion 112 and/or may be positioned in the chip outlet portion 112. The centering feature 370, which may include a tapered inner surface 372, may act to substantially vertically align the stack of chips 208 as the chips 208 travel through the chip outlet hole 116 for use in a wagering game (e.g., as the chips 208 are pushed upward by the plunger 504). In some embodiments, the centering feature 370 may be formed as a solid member (e.g., a solid tapered ring) or may be defined by a number of fingers (e.g., inwardly directed fingers 402 as shown and described below in relation to FIG. 9). In some embodiments, the one or more flanges 118 of the chip outlet portion 112 may act to substantially vertically align the stack of chips 208 as the chips 208 travel through the chip outlet hole 116 for use in a wagering game.

Figure 9:
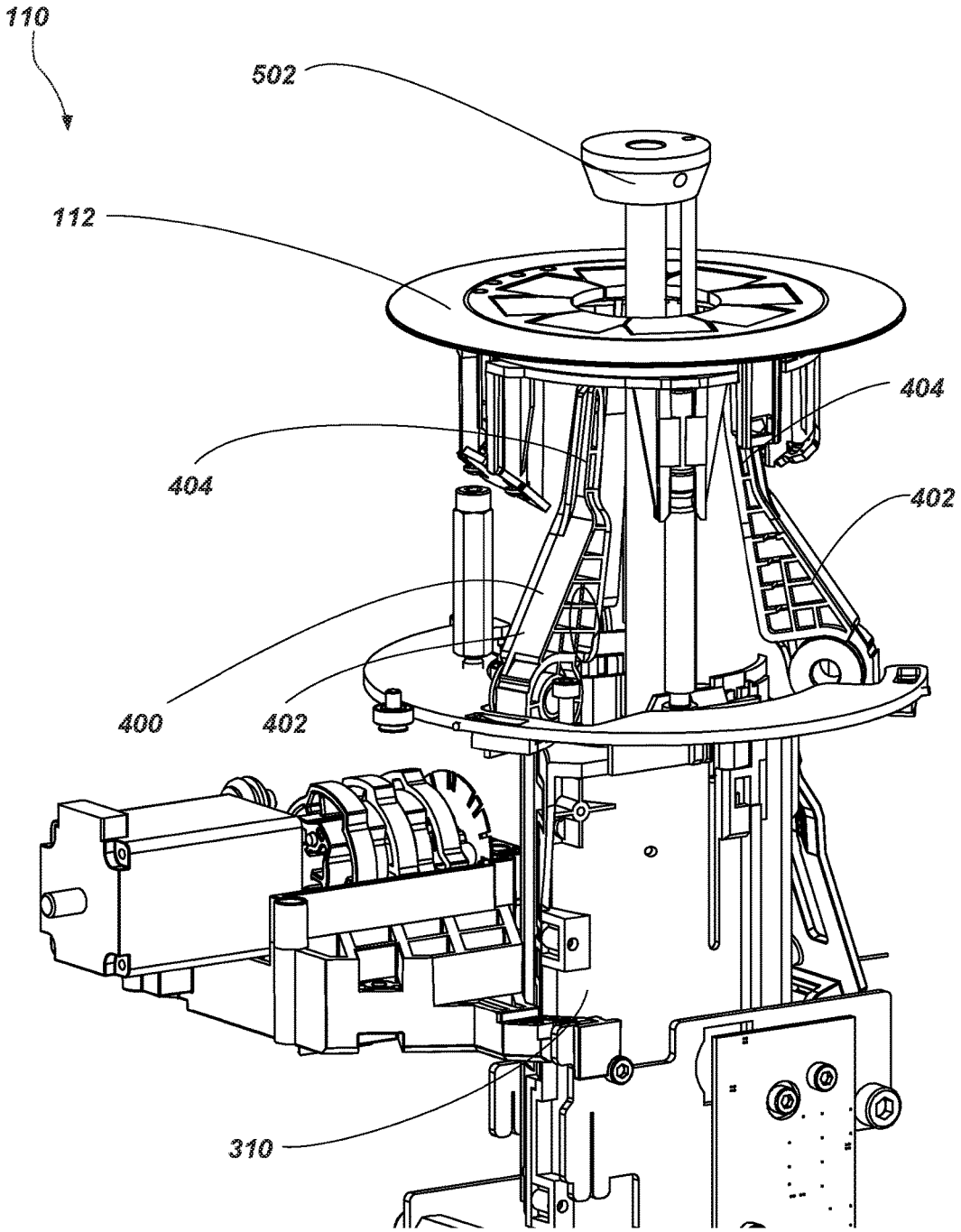
FIG. 9 is a perspective view of a portion of a chip collection tube (e.g., a chip collection tube of the chip sorting device of FIG. 1).

FIG. 9 is a perspective view of a portion of a chip collection tube (e.g., a chip collection tube 110 of the chip sorting device 100 of FIG. 1). As shown in FIG. 9, the chip collection tube 110 may include centering feature 400 that includes multiple elements for centering the chips (e.g., inwardly directed fingers 402 that are rotatably coupled to the collection tube 110). The fingers 402 may include elongated portions 404 having inner surfaces that contact the chips as the chips are lifted to the table surface and act to center the chips (e.g., in a manner similar to that discussed above).

As shown in FIG. 9, the chip receiver 110 may travel only to an area proximate the lower end of the centering feature 400, while the plunger assembly 502 alone travels upward through the centering feature 400 and through the chip outlet portion 112 to a position at or above the table surface.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. A chip sorting device, comprising:

a chip conveyor unit comprising at least one chip well for transporting chips; and at least one chip collection tube for receiving at least some of the chips from the chip conveyor unit, the at least one chip collection tube comprising a chip stack having an alignment cup for containing the at least some of the chips therein, at least a portion of the chip stack alignment cup having an inner lateral dimension that is larger than a dimension of the at least some of the chips to enable a lateral position of each of the at least some of the chips in a chip stack to vary after the at least some of the chips have been received from the chip conveyor unit; and a plunger configured to move both the chip stack alignment cup and the chip stack from a first position to a second position.

2. The chip sorting device of claim 1, wherein the plunger is configured to move the chip stack alignment cup and the chip stack to a position where an upper portion of the chip stack alignment cup is positioned proximate a surface of a gaming table.

3. The chip sorting device of claim 1, wherein the at least one chip collection tube comprises a reduced dimension section proximate an output portion of the at least one chip collection tube through which the at least some of the chips are configured to exit, the reduced dimension section having a reduced lateral dimension being less than the inner lateral dimension.

4. The chip sorting device of claim 3, wherein the reduced dimension section is configured to vertically align the at least some of the chips into a substantially vertically aligned stack of chips as the at least some of the chips in the chip stack exit the at least one chip collection tube.

5. The chip sorting device of claim 1, further comprising at least one insert sized and configured to be received in the chip stack alignment cup of the at least one chip collection tube to accommodate different sized chips.

6. A chip sorting device, comprising:

at least one chip collection tube for receiving chips, the at least one chip collection tube comprising a chip stack alignment cup for containing at least some of the chips therein; and a plunger configured to move both the chip stack alignment cup and a chip stack from a first position to a second position, wherein the chip sorting device is configured to move only the plunger past the second position while the chip stack alignment cup remains at the second position.

7. The chip sorting device of claim 6, wherein the plunger is configured to move the chip stack alignment cup and the chip stack to the second position where an upper portion of the chip stack alignment cup is positioned proximate a surface of a gaming table.

8. The chip sorting device of claim 7, wherein the chip stack alignment cup is sized and configured to at least partially contain the chip stack as the chip stack is moved toward the surface of the gaming table.

9. The chip sorting device of claim 6, wherein the plunger is configured to move incrementally downward after each chip is received in the chip stack.

10. A chip sorting device, comprising:

a chip conveyor unit comprising at least one chip well for transporting chips; and at least one chip collection tube for receiving at least some of the chips from the chip conveyor unit, the at least one chip collection tube comprising a chip stack alignment cup for containing the at least some of the chips therein, at least a portion of the chip stack alignment cup having an inner lateral dimension that is larger than a dimension of the at least some of the chips to enable a lateral position of each of the at least some of the chips in a chip stack to vary after the at least some of the chips have been received from the chip conveyor unit;

a centering feature; and a plunger configured to move both the chip stack alignment cup and the chip stack from a first position to a second position and to urge the chip stack though the chip stack alignment cup to engage the centering feature to align the lateral position of the chips of the chip stack.

11. A chip sorting device for a gaming table having a top surface and at least one opening in the top surface to pass a stack of chips through the top surface, comprising:

a chip conveyor unit comprising at least one chip well for transporting chips; and at least one chip collection tube for receiving chips from the chip conveyor unit, the at least one chip collection tube comprising a chip stack alignment cup for containing at least some of the chips therein, at least a portion of the chip stack alignment cup having an inner lateral dimension that is larger than the diameter of the chips to enable diametrical, lateral position of the chips in a chip stack to vary;

a plunger configured to move the at least one collection tube and chip stack alignment cup vertically to push the chip stack along a path through the chip stack alignment cup and the at least one opening in the top surface; and a centering apparatus in the chip stack alignment cup to engage and laterally align the chips and the chip stack travels along the path;

whereby a laterally aligned stack of chips is presented through the at least one opening.

12. The chip sorting device of claim 11, wherein the centering apparatus comprises a tapered inner surface.

13. The chip sorting device of claim 11, wherein the centering apparatus includes rotatable fingers.

14. The chip sorting device of claim 11, further comprising a cup insert sized and configured to be received in the at least one chip collection tube to accommodate different sized chips.

* * * * *